US010113701B1

(12) United States Patent
Lu et al.

(10) Patent No.: US 10,113,701 B1
(45) Date of Patent: Oct. 30, 2018

(54) WORKING LIGHT

(71) Applicant: Xiamen PVTECH Co., Ltd., Xiamen, Fujian (CN)

(72) Inventors: Fuxing Lu, Fujian (CN); Xiaoping Lan, Fujian (CN)

(73) Assignee: Xiamen PVTECH Co., Ltd., Xiamen, Fujian (CN)

( * ) Notice: Subject to any disclaimer, the term of this patent is extended or adjusted under 35 U.S.C. 154(b) by 0 days.

(21) Appl. No.: 15/839,861

(22) Filed: Dec. 13, 2017

(30) Foreign Application Priority Data

Sep. 8, 2017 (CN) ..... 2017 1 0805110

(51) Int. Cl.

| | |
|---|---|
| ***F21V 21/00*** | (2006.01) |
| ***F21S 2/00*** | (2016.01) |
| ***F21V 21/30*** | (2006.01) |
| ***F21V 11/00*** | (2015.01) |
| ***F21V 23/04*** | (2006.01) |
| ***F21V 17/12*** | (2006.01) |
| ***F21V 23/06*** | (2006.01) |
| *F21Y 115/10* | (2016.01) |

(52) U.S. Cl.
CPC ..... *F21S 2/005* (2013.01); *F21V 11/00* (2013.01); *F21V 17/12* (2013.01); *F21V 21/30* (2013.01); *F21V 23/04* (2013.01); *F21V 23/06* (2013.01); *F21Y 2115/10* (2016.08)

(58) Field of Classification Search
USPC ..... 362/235, 249.02, 220, 89
See application file for complete search history.

(56) References Cited

U.S. PATENT DOCUMENTS

| | | | | |
|---|---|---|---|---|
| 2008/0089071 | A1* | 4/2008 | Wang | F21S 2/005 362/294 |
| 2008/0239730 | A1* | 10/2008 | Chien | F21L 14/02 362/368 |
| 2011/0305056 | A1* | 12/2011 | Chien | F21S 8/035 363/178 |
| 2015/0029721 | A1* | 1/2015 | Kim | F21K 9/00 362/249.02 |
| 2015/0159818 | A1* | 6/2015 | Dong | H05B 33/0854 315/151 |
| 2016/0109079 | A1* | 4/2016 | McKinley | F02B 63/047 362/89 |
| 2017/0191640 | A1* | 7/2017 | Ji | F21V 29/89 |
| 2018/0042076 | A1* | 2/2018 | Nolan | H05B 33/086 |

* cited by examiner

*Primary Examiner* — Allyson Trail
(74) *Attorney, Agent, or Firm* — Winston Hsu

(57) ABSTRACT

A working light includes a frame and a plurality of LED modules located in the frame. Two supporting plates at two ends of the frame are respectively combined with two ratchets. Two ends of the LED modules are combined with ratchet plates. The ratchets are respectively assembled to the ratchet plates to control a rotation angle of the LED modules. The working lights can be stacked with each other in one or more directions. The ratchets are at the side portions of the LED module. Therefore, after the LED module is assembled in the frame of the working light, the ratchets allow the LED module to be rotatable within 180 degrees. Hence, the LED module can be rotated, so that the illumination angle of the LED module is adjustable.

9 Claims, 9 Drawing Sheets

WORKING LIGHT

BACKGROUND OF THE INVENTION

1. Field of the Invention

The present invention relates to a light, in particular to a light for working.

2. Description of the Prior Art

Recent years, with the rapid developments of mechanical and electronics industries, components of these fields are continuously provide for the markets. When a technician assemble or repair a component, the technician may use soldering techniques frequently. During the soldering procedure, a light for illumination is needed to ensure the precision of the soldering task. A common lighting device is a working light.

The working light can be used in nighttime road construction, soldering, or in other mechanical processing procedures. The working light can provide sufficient illumination brightness and better eyesight. A conventional working light uses a bulb as the light source. However, the light of the bulb is dispersed. As a result, the light of the bulb cannot be gathered, and the user cannot have sufficient eyesight during the operation, even causing occupational accidents. Furthermore, the conventional light bulb is power consumptive and non-recyclable. Hence, the conventional light bulb is not environmentally friendly.

The conventional working light is a single module and cannot be repaired conveniently. Moreover, the base of the conventional working light is tilted. As a result, the conventional working lights cannot be stacked with each other. Therefore, the conventional working light has limited application. Accordingly, how to solve the problems is an issue.

SUMMARY OF THE INVENTION

In view of these problems, the present invention provides a working light, wherein the working light comprises a frame and a plurality of LED modules located in the frame. Two supporting plates at two ends of the frame are respectively combined with two ratchets. Two ends of the LED modules are combined with ratchet plates. The ratchets are respectively assembled to the ratchet plates to control a rotation angle of the LED modules.

In some embodiments, a frame of another working light is stacked on the frame of the working light.

In some embodiments, each of the LED modules comprises an aluminum-extruded profile, a light source plate fixed on the aluminum-extruded profile, a lightshade fixed on the aluminum-extruded profile, and a power device connected to the light source plate.

In some embodiments, the aluminum-extruded profile comprises a USB port, a power receptacle, and a switch. The USB port, the power receptacle, and the switch are connected to the light source plate and the power device.

In some embodiments, two ends of each of the aluminum-extruded profiles are respectively combined with two side covers. Adjacent side covers are arranged side by side, and each of the ratchet plates is fixed between the corresponding adjacent side covers that are arranged side by side.

In some embodiments, each of the aluminum-extruded profiles comprises a waterproof plug and a module connection cable inserted into the waterproof plug to allow the LED modules be electrically connected with each other.

In some embodiments, the working light further comprises an upper cover covering out of the USB port, the power receptacle, and the switch.

In some embodiments, each of the ratchets is combined with a spring and a pinball, and the pinball is elastically abutted in the corresponding ratchet plate.

In some embodiments, the two supporting plates at two ends of the frame are respectively threaded with two threading components, the two threading components are respectively combined with the ratchets, and the two threading components are manually operable.

The working light is modularized, so that the replacement of the working light is convenient. The LED modules can be replaced after the threading components are detached, and a damaged LED module can be replaced by a new LED module. Accordingly, the maintenance of the working light is convenient.

Several working lights may be stacked with each other in one or more directions. After the working lights are stacked with each other, the LED modules can be connected with each other in a simple manner; specifically, the receptacles (e.g., USB receptacles) at the back of the LED modules allow the LED to be connected with each other easily.

The ratchets are at the side portions of the LED module. Therefore, after the LED module is assembled in the frame of the working light, the ratchets allow the LED module to be rotatable within 180 degrees. Hence, the LED module can be rotated, so that the illumination angle of the LED module is adjustable.

The LED module is assembled with the lightshade having a diffusion function to prevent glaring problem. It is understood that the conventional working light may have glaring problem to irritate user's eyes.

The back of the LED is connected to a long power cable. According to one embodiment of the present invention, the hooks are directly assembled on the frame for winding and storing the cable, and the power cable is received and winded within the frame. After the power cable is stored, the power cable is received within the working light. Conversely, a T-shaped post provided nearby the conventional working light is further needed for winding the cable, the winded portion of the cable is out of the working light, and the post has to be locked with the working light by a locking member. On the other hand, the switch at the back of the LED module has the upper cover to provide waterproof function to the switch box.

The detailed features and the advantages of the present invention will become more obvious from the following description for any person having ordinary skills in the art to carry out the claimed invention. Further, based on the disclosure, the claims, and the accompanying drawings, any person having ordinary skills in the art can understand the purpose and the advantages of the present invention easily.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
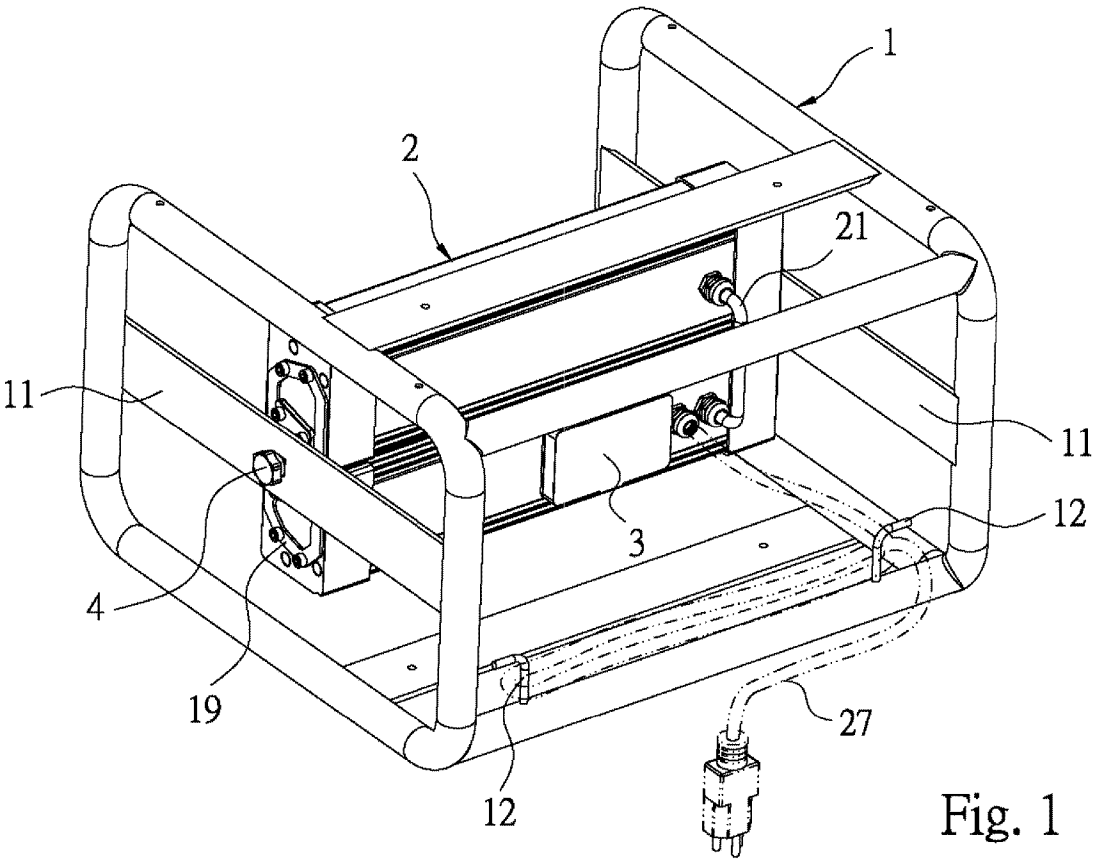
FIG. 1 illustrates a perspective view (1) of a working light according to an exemplary embodiment of the present invention.

The advantages, features and the way to achieve the invention are referred to the exemplary embodiments and the drawing for detail description to be understood in a much easier manner. However, it is understood that the invention can have different modifications and the scope of the invention is not limited to the provided embodiments. Conversely, the provided embodiments allow person having ordinary skills in the art to realize the disclosure clearly and fully, such that person in the art can realize the scope of the claimed invention via the provided embodiments. The claimed invention is solely defined by the appended claims. In the drawings, for the sake of clarity, the absolute and relative sizes of the components are presented in an exaggeration manner. In the specification, the components with the same numerical numbers are same components. As used hereinafter, the term "and/or" includes any listed item and all combinations of one or more of the listed items.

Unless otherwise defined, all terms (including technology and scientific terms) have the same meanings as realized by the person having ordinary skills in the art. It is understood that, the definitions of those terms used in a dictionary should be understood as the meanings consistent with the relevant art, and unless the terminologies are clearly defined in the description, the terms shall not be realized in overly idealized or overly formal manner.

Embodiments are described by the following paragraphs along with appended drawings. However, it is understood that, these embodiments may have modifications and they shall not be used for interpreting the claimed scope of the present invention. These embodiments allow the disclosure of the present invention to be full and clear. Therefore, person having ordinary skills in the art can realize the scope of the invention from these embodiments.

Figure 2:
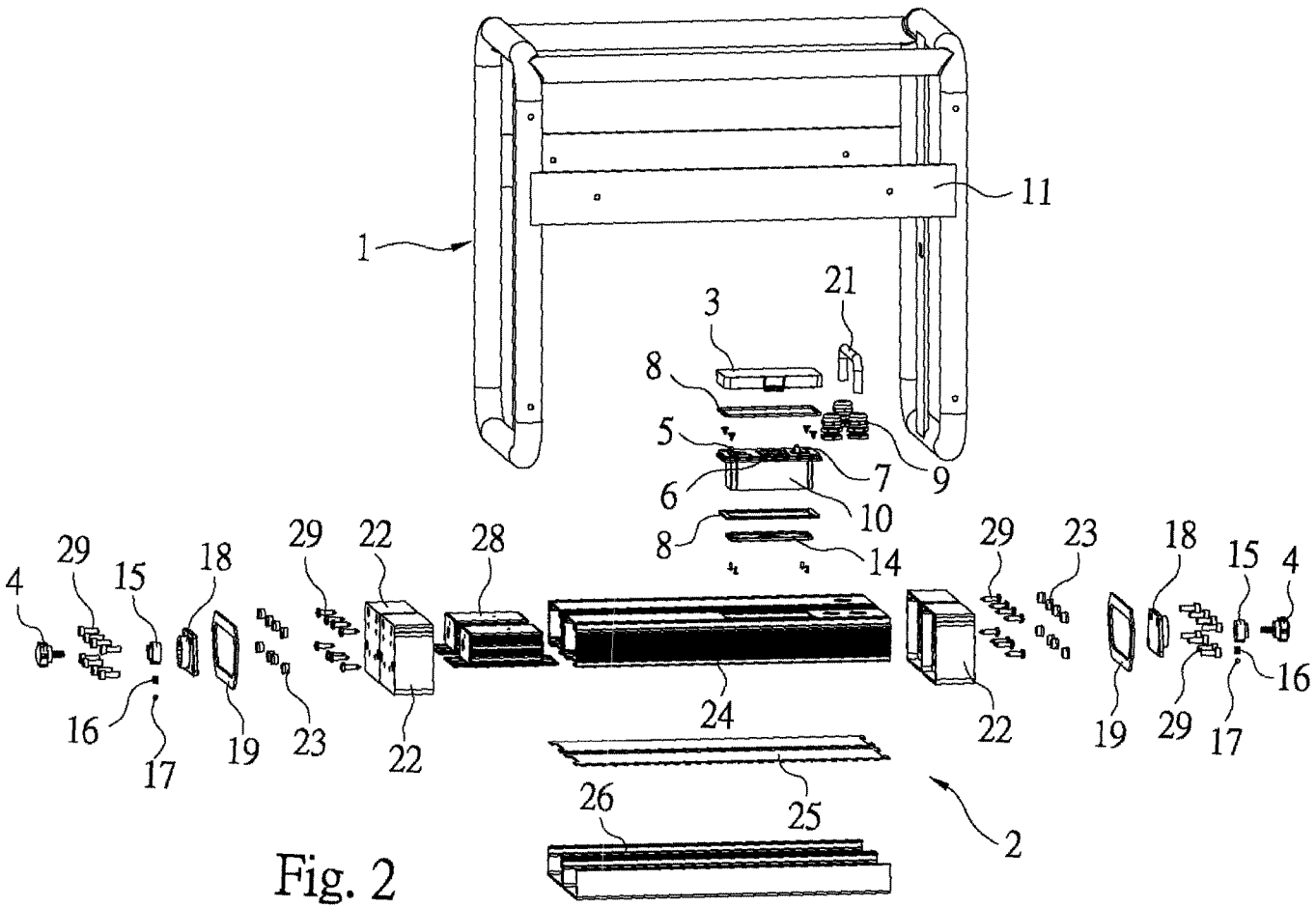
FIG. 2 illustrates an exploded view of the working light.
Figure 3:
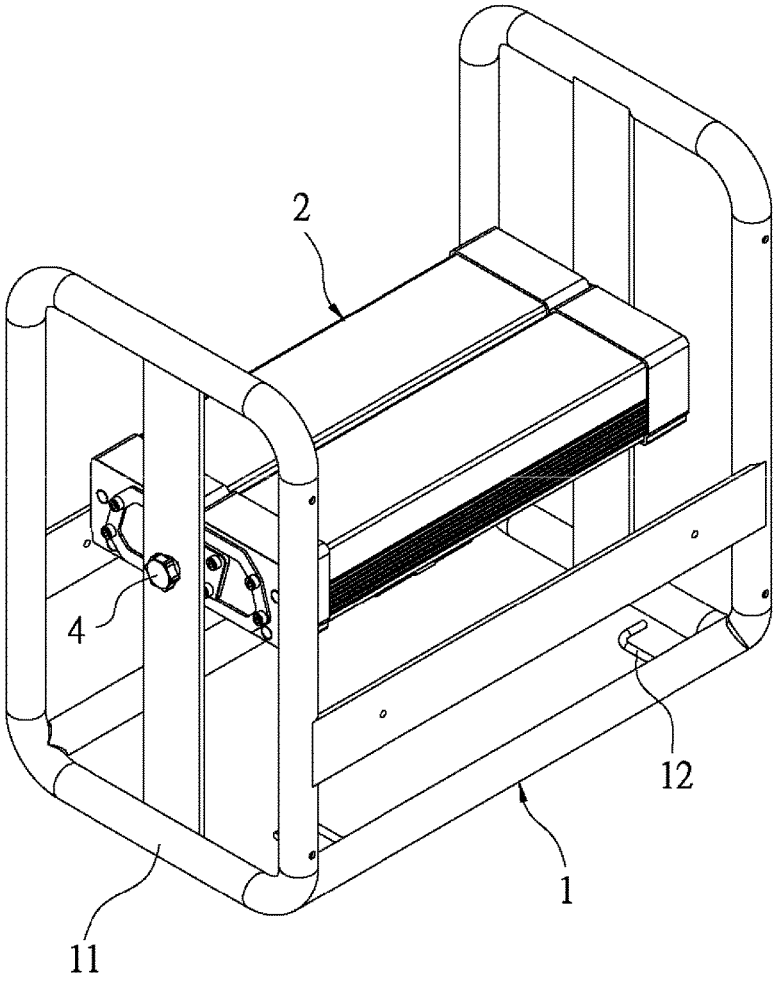
FIG. 3 illustrates a perspective view (2) of the working light.
Figure 4:
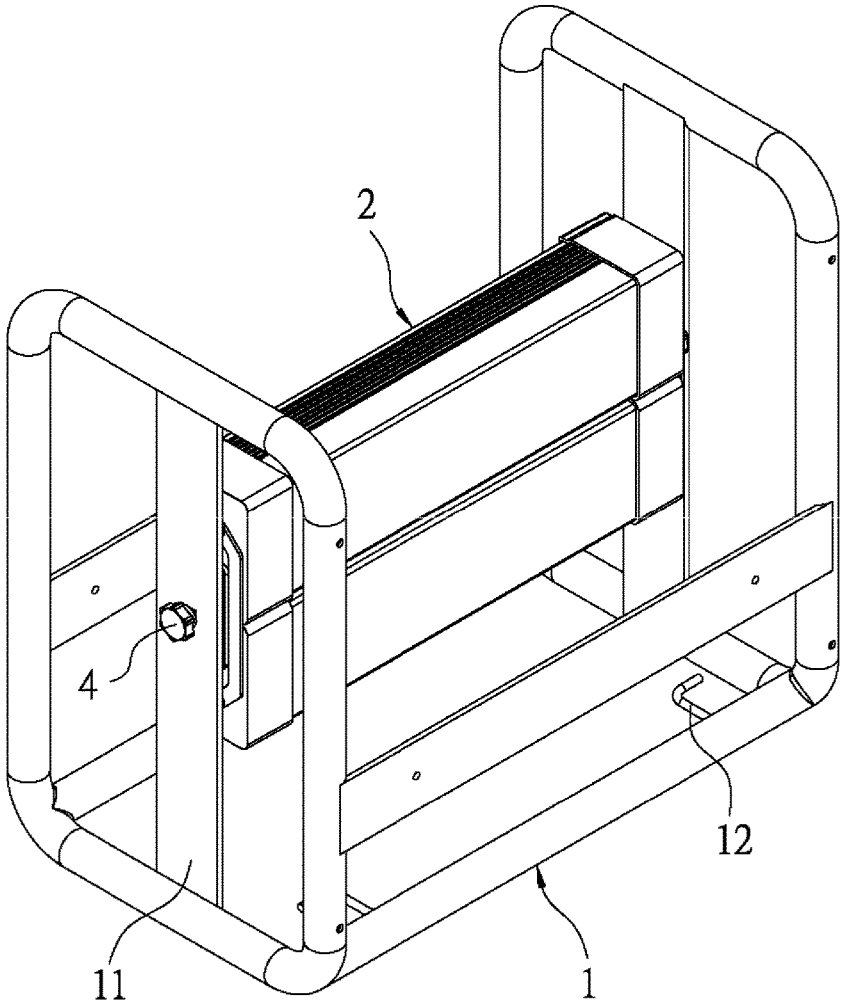
FIG. 4 illustrates a perspective view (3) of the working light.
Figure 5:
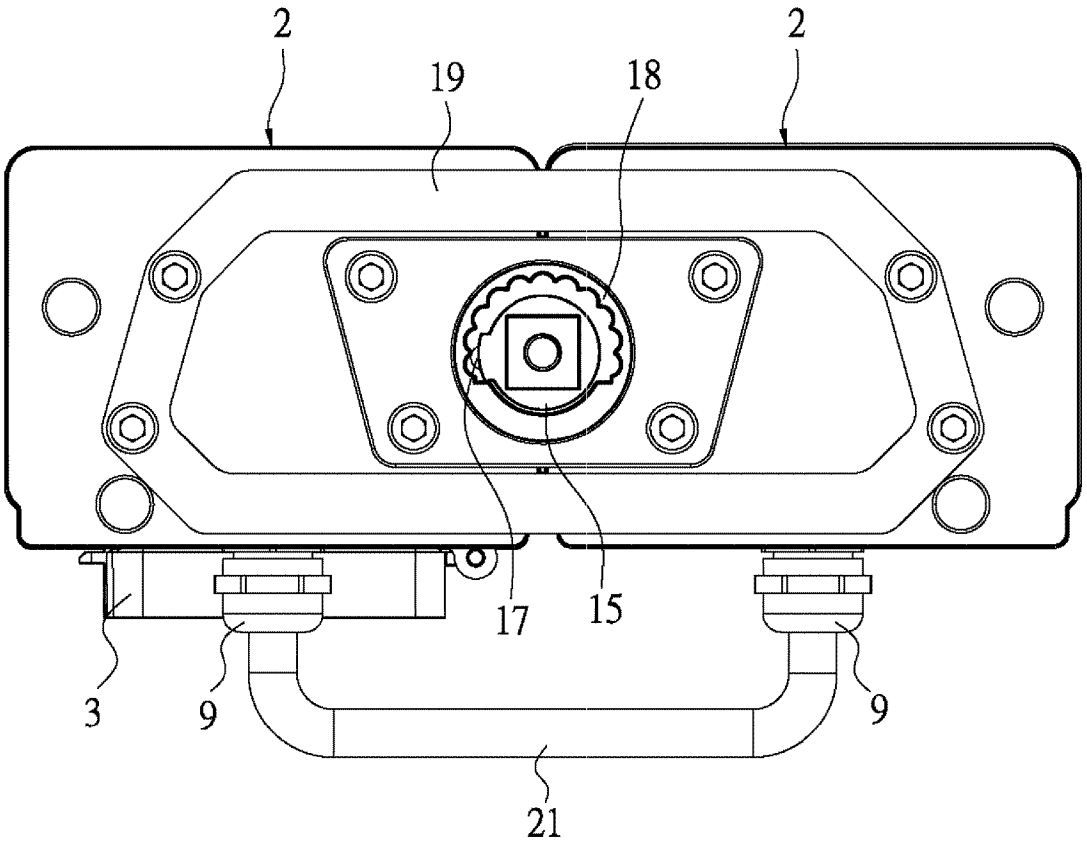
FIG. 5 illustrates a side schematic view (1) showing the rotation of ratchets of the working light.
Figure 6:
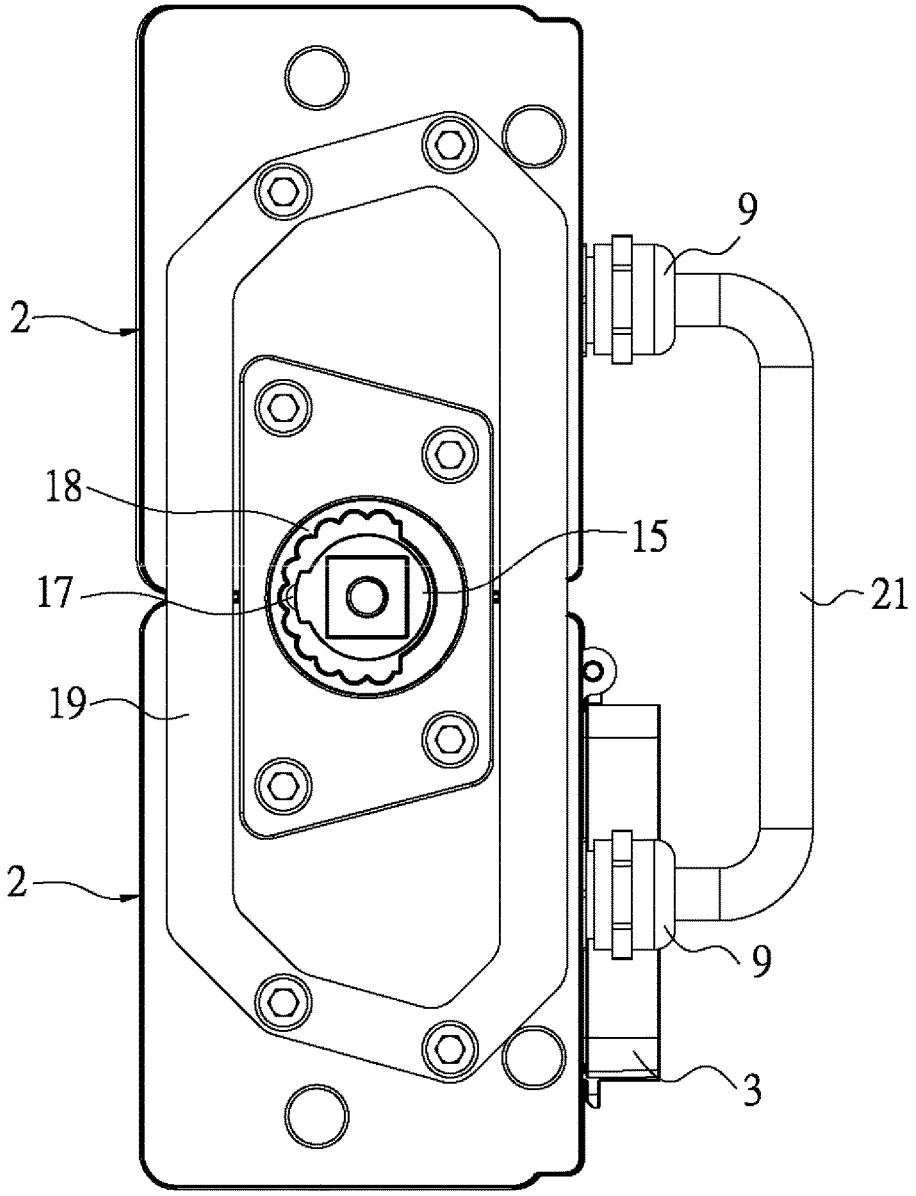
FIG. 6 illustrates a side schematic view (2) showing the rotation of the ratchets of the working light.
Figure 7:
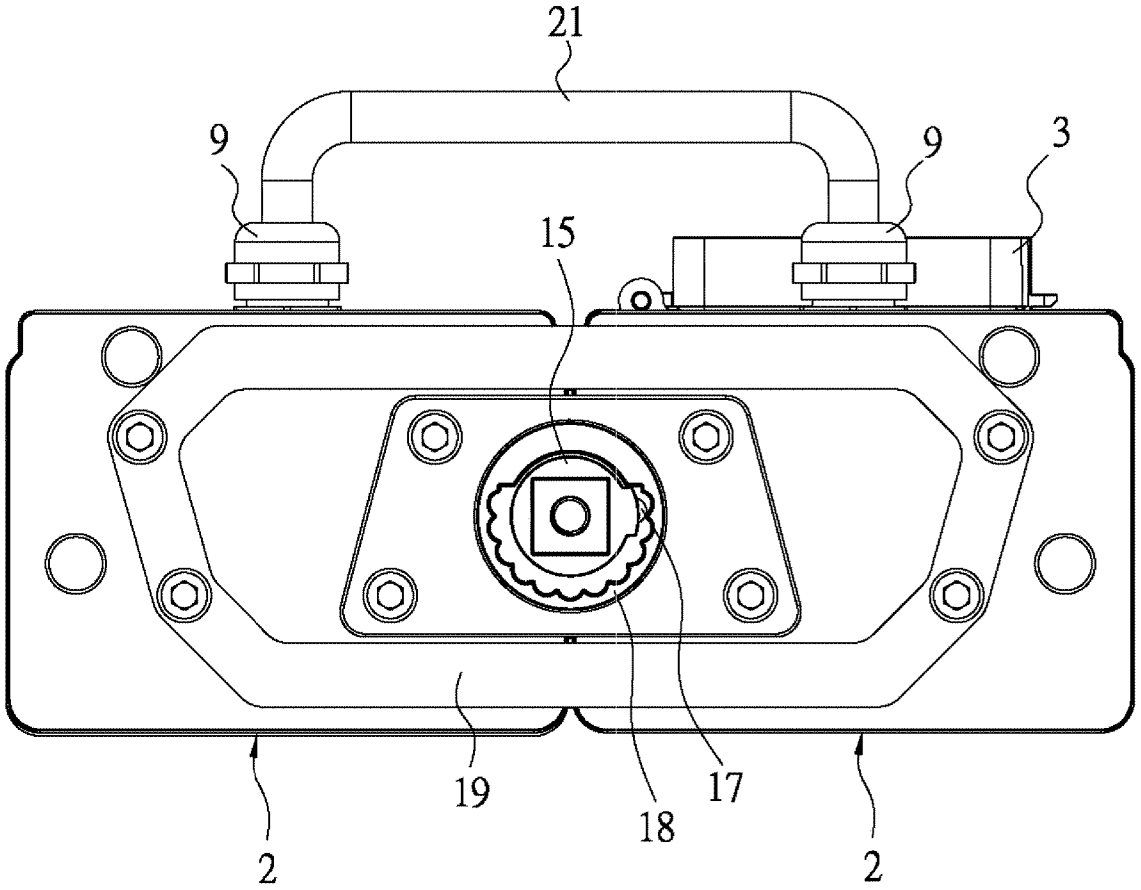
FIG. 7 illustrates a side schematic view (3) showing the rotation of the ratchets of the working light.
Figure 8:
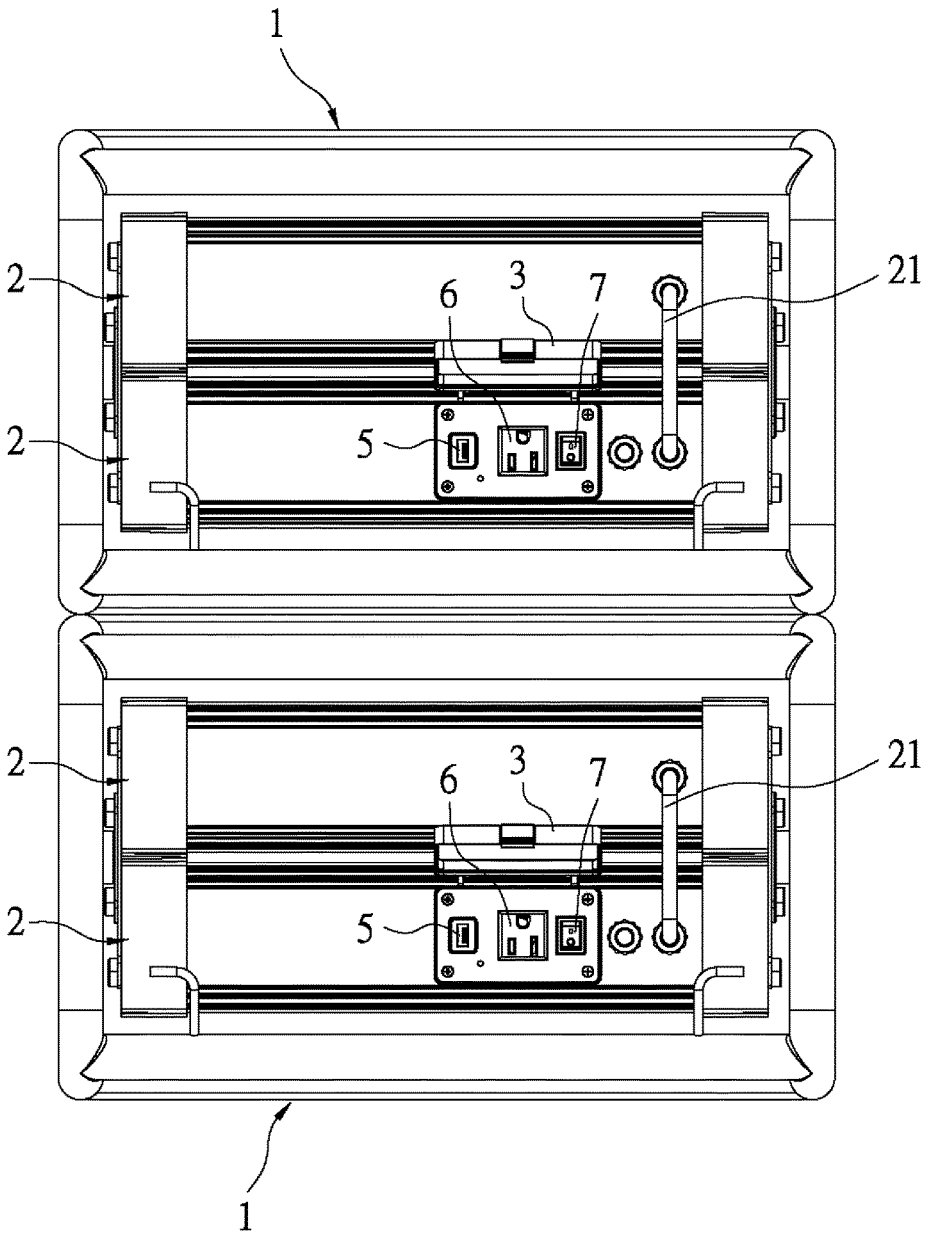
FIG. 8 illustrates a side schematic view (1) showing the working light is stacked with another working light.
Figure 9:
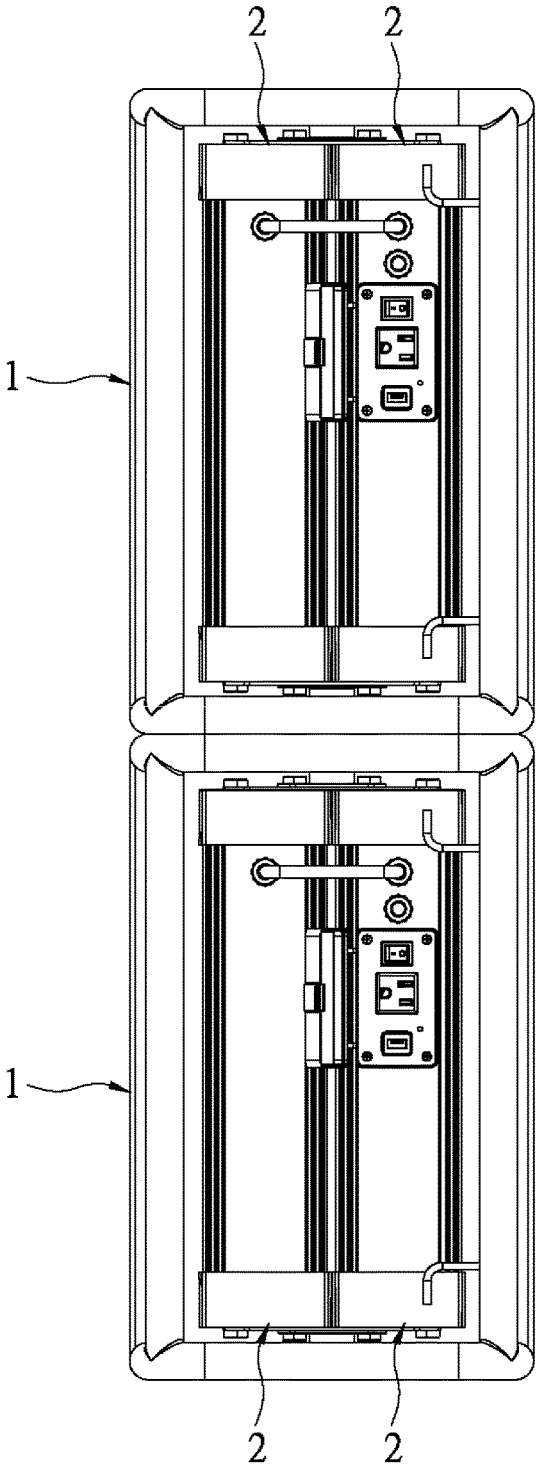
FIG. 9 illustrates a side schematic view (2) showing the working light is stacked with another working light.

Please refer to FIGS. 1 to 9, illustrating a working light according to an exemplary embodiment of the present invention. FIG. 1 illustrates a perspective view (1) of the working light. FIG. 2 illustrates an exploded view of the working light. FIG. 3 illustrates a perspective view (2) of the working light. FIG. 4 illustrates a perspective view (3) of the working light. FIG. 5 illustrates a side schematic view (1) showing the rotation of ratchets 15. FIG. 6 illustrates a side schematic view (2) showing the rotation of the ratchets 15. FIG. 7 illustrates a side schematic view (3) showing the rotation of the ratchets 15. FIG. 8 illustrates a side schematic view (1) showing the working light is stacked with another working light. FIG. 9 illustrates a side schematic view (2) showing the working light is stacked with another working light. In this embodiment, the working light comprises a frame 1 and a plurality of LED modules 2.

Please refer to FIGS. 1 to 9. The frame 1 is formed by soldering a plurality of supporting plates 11 with each other to form a rectangular frame 1. The frame 1 has a long side and a short side from a side view. The frame 1 can be placed on the ground with the long side or with the short side. When the frame 1 is placed on the ground with the long side, a frame 1 of another working light can be stacked on the other long side at the top of the frame 1. Alternatively, when the frame 1 is placed on the ground with the short side, a frame 1 of another working light can be stacked on the other short side at the top of the frame 1. Furthermore, in order to allow the stacked working lights to be stably positioned, a fixing structure may be further assembled with the stacked working lights.

Please refer to FIGS. 1 to 9. Hooks 12 are assembled on the frame 1. Therefore, a power cable 27 connecting to and extending from the LED modules 2 can be directly placed on the hooks 12 for storage.

Please refer to FIGS. 1 to 9. Two supporting plates 11 at two ends of the frame 1 are respectively combined with two ratchets 15 and two threading components 4. The ratchet 15 is assembled on an inner side of the supporting plate 11, and the threading component 4 is passing through the supporting plate 11 from an outer side of the supporting plate 11 and threaded with the ratchet 15. In other words, the two supporting plates 11 at two ends of the frame 1 are respectively threaded with the two threading components 4, and the two threading components 4 are respectively combined with the ratchets 15 and are manually operable. Therefore, a user can, with bare hands, rotate the threading component 4 at the outer side of the supporting plate 11 to lock the threading component 4 with the supporting plate 11 or to release the threading component 4 so as to detach the LED modules 2 from the frame 1.

Please refer to FIGS. 1 to 9. The LED modules 2 are located in the frame 1. Two ends of the LED modules 2 are respectively combined with ratchet plates 18. The ratchets 15 are respectively assembled to the ratchet plates 18 to control a rotation angle of the LED modules 2. A spring 16 and a pinball 17 are combined with each of the ratchets 15, and the pinball 17 is elastically abutted in the corresponding ratchet plate 18.

Please refer to FIGS. 1 to 9. The ratchet plate 18 has an arc-shaped groove, and the arc-shaped groove has a plurality of recesses. The pinball 17 is pushed by the spring 16 and engaged in the recess. The angle of the arc-shaped groove is 180 degrees. Therefore, the ratchets 15 can be rotated within 180 degrees, so that the LED modules 2 can be provided for illumination after rotation.

Please refer to FIGS. 1 to 9. Each of the LED modules 2 comprises an aluminum-extruded profile 24, a light source plate 25 fixed on the aluminum-extruded profile 24, a lightshade 26 fixed on the aluminum-extruded profile 24, and a power device 28 connected to the light source plate 25. The LED module 2 is assembled with the lightshade 26 having a diffusion function to prevent glaring problem.

Please refer to FIGS. 1 to 9. The aluminum-extruded profile 24 comprises a USB port 5, a power receptacle 6, and a switch 7. The USB port 5, the power receptacle 6, and the switch 7 are connected to the light source plate 25 and the power device 28. The working light can be connected to an electronic device via the USB port 5 to receive messages from the electronic device. The working light can be connected to a power cable via the power receptacle 6 to provide electricity for the LED module 2. The user can turn the LED module 2 conveniently via the switch 7.

Please refer to FIGS. 1 to 9. The aluminum-extruded profile 24 has a recessed hole. The USB port 5, the power receptacle 6, and the switch 7 are assembled in a switch box 10. A bottom cover 14 is assembled on a bottom of the switch box 10 and received in the recessed hole, and the USB port 5, the power receptacle 6, and the switch 7 are exposed from the aluminum-extruded profile 24.

Please refer to FIGS. 1 to 9. Each of the aluminum-extruded profiles 24 further comprises an upper cover 3 covering out of the USB port 5, the power receptacle 6, and the switch 7. When the working light is in use, the upper cover 3 can be opened, so that the switch 7 is ready to be operated. Conversely, when the working light is not in use, the upper cover 3 is closed to cover the USB port 5, the power receptacle 6, and the switch 7. Therefore, with the use of the upper cover 3, the problems of water entering into the switch box 10 or user's unintentional touch of the switch can be prevented.

Please refer to FIGS. 1 to 9. Washers 8 are assembled between the upper cover 3 and the bottom cover 14 and between the bottom cover 14 and the aluminum-extruded profile 24 for preventing water entering into the switch box 10 easily.

Please refer to FIGS. 1 to 9. Two ends of each of the aluminum-extruded profiles 24 are respectively combined with two side covers 22. Adjacent side covers 22 are arranged side by side. Each of the side covers 22 has several lock holes for locking with several locking members 29, so that the side covers 22 are combined with the aluminum-extruded profile 24, and the lock holes are sealed with taps 23.

Please refer to FIGS. 1 to 9. Each of the ratchet plates 18 is fixed between the corresponding adjacent side covers 22 that are arranged side by side. A connection member 19 is fixed with the side-by-side arranged side covers 22, so that the LED modules 2 are connected with each other through the connection members 19.

Please refer to FIGS. 1 to 9. Each of the aluminum-extruded profiles 24 comprises a waterproof plug 9 and a module connection cable 21 inserted into the waterproof plug 9 to allow the LED modules 2 to be electrically connected with each other.

The working light is modularized, so that the replacement of the working light is convenient. The LED modules can be replaced after the threading components are detached, and a damaged LED module can be replaced by a new LED module. Accordingly, the maintenance of the working light is convenient.

Several working lights may be stacked with each other in one or more directions. After the working lights are stacked with each other, the LED modules can be connected with each other in a simple manner; specifically, the receptacles (e.g., USB receptacles) at the back of the LED modules allow the LED to be connected with each other easily.

The ratchets are at the side portions of the LED module. Therefore, after the LED module is assembled in the frame of the working light, the ratchets allow the LED module to be rotatable within 180 degrees. Hence, the LED module can be rotated, so that the illumination angle of the LED module is adjustable.

The LED module is assembled with the lightshade having a diffusion function to prevent glaring problem. It is understood that the conventional working light may have glaring problem to irritate user's eyes.

The back of the LED is connected to a long power cable. According to one embodiment of the present invention, the hooks are directly assembled on the frame for winding and storing the cable, and the power cable is received and winded within the frame. After the power cable is stored, the power cable is received within the working light. Conversely, a T-shaped post provided nearby the conventional working light is further needed for winding the cable, the winded portion of the cable is out of the working light, and the post has to be locked with the working light by a locking member. On the other hand, the switch at the back of the LED module has the upper cover to provide waterproof function to the switch box.

Although particular embodiments of the invention have been described in detail for purposes of illustration, various modifications and enhancements may be made without departing from the spirit and scope of the invention. Accordingly, the invention is not to be limited except as by the appended claims.

As above, the prevent invention is innovative and has the improved performance. The present invention is non-obvious in view of the relevant arts and has inventive steps and utility.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A working light, comprising: a frame and a plurality of LED modules located in the frame, wherein two supporting plates at two ends of the frame are respectively combined with two ratchets, two ends of the LED modules are combined with ratchet plates, the ratchets are respectively assembled to the ratchet plates to control a rotation angle of the LED modules, wherein each of the ratchets is combined with a spring and a pinball, and the pinball is elastically abutted in the corresponding ratchet plate.

2. The working light according to claim 1, wherein a frame of another working light is stacked on the frame of the working light.

3. The working light according to claim 1, wherein each of the LED modules comprises an aluminum-extruded profile, a light source plate fixed on the aluminum-extruded profile, a lightshade fixed on the aluminum-extruded profile, and a power device connected to the light source plate.

4. The working light according to claim 3, wherein the aluminum-extruded profile comprises a USB port, a power receptacle, and a switch, the USB port, the power receptacle, and the switch are connected to the light source plate and the power device.

5. The working light according to claim 4, wherein two ends of each of the aluminum-extruded profiles are respectively combined with two side covers, adjacent side covers are arranged side by side, and each of the ratchet plates is fixed between the corresponding adjacent side covers that are arranged side by side.

6. The working light according to claim 5, wherein a connection member is fixed with each adjacent side covers.

7. The working light according to claim 4, further comprising an upper cover covering out of the USB port, the power receptacle, and the switch.

8. The working light according to claim 3, wherein each of the aluminum-extruded profiles comprises a waterproof plug and a module connection cable inserted into the waterproof plug to allow the LED modules be electrically connected with each other.

9. The working light according to claim 1, wherein the two supporting plates at two ends of the frame are respectively threaded with two threading components, the two threading components are respectively combined with the ratchets and the two threading components are manually operable.

* * * * *